US011502414B2

(12) United States Patent
Parsche

(10) Patent No.: US 11,502,414 B2
(45) Date of Patent: Nov. 15, 2022

(54) MICROSTRIP PATCH ANTENNA SYSTEM HAVING ADJUSTABLE RADIATION PATTERN SHAPES AND RELATED METHOD

(71) Applicant: Eagle Technology, LLC, Melbourne, FL (US)

(72) Inventor: Francis E. Parsche, Palm Bay, FL (US)

(73) Assignee: EAGLE TECHNOLOGY, LLC, Melbourne, FL (US)

( * ) Notice: Subject to any disclaimer, the term of this patent is extended or adjusted under 35 U.S.C. 154(b) by 51 days.

(21) Appl. No.: 17/162,256

(22) Filed: Jan. 29, 2021

(65) Prior Publication Data

US 2022/0247082 A1 Aug. 4, 2022

(51) Int. Cl.
*H01Q 9/04* (2006.01)
*H01Q 21/00* (2006.01)
(Continued)

(52) U.S. Cl.
CPC ..... *H01Q 9/0407* (2013.01); *H01Q 5/385* (2015.01); *H01Q 5/40* (2015.01); *H01Q 9/0414* (2013.01);
(Continued)

(58) Field of Classification Search
CPC .... H01Q 9/0442; H01Q 9/0407; H01Q 1/526; H01Q 1/38; H01Q 9/045; H01Q 13/08;
(Continued)

(56) References Cited

U.S. PATENT DOCUMENTS 1,892,221 A 12/1932 Runge
2,973,514 A 2/1961 Sprague
(Continued)

FOREIGN PATENT DOCUMENTS

EP 0403910 12/1990
JP 2008181562 8/2008
WO WO2010029304 3/2010

OTHER PUBLICATIONS

Long et al. "A dual-frequency stacked circular-disc antenna" IEEEE Transactions on Antennas and Propagation: 1979; vol. 27, Issue 2 https://ieeexplore.ieee.org/stamp/stamp.jsp?tp=&arnumber=1142078 Abstract Only.
(Continued)

*Primary Examiner* — Vibol Tan
(74) *Attorney, Agent, or Firm* — Allen, Dyer, Doppelt + Gilchrist, P.A.

(57) ABSTRACT

An antenna device may include a ground plane, a first planar antenna element spaced above the ground plane and having an opening, and a second planar antenna element spaced above the first planar antenna element on a side of the first planar antenna element opposite the ground plane. The second planar antenna element may have a size smaller than the first planar antenna element. The antenna device may include a coaxial feed with an outer conductor, and an inner conductor surrounded by the outer conductor and extending outwardly from an end of the outer conductor. The outer conductor may be coupled to the ground plane and the first planar antenna element. The inner conductor may extend through the opening in the first planar antenna element and may be coupled to the second planar antenna element.

20 Claims, 14 Drawing Sheets

(51) Int. Cl.

| | |
|---|---|
| ***H01Q 9/06*** | (2006.01) |
| ***H01Q 5/40*** | (2015.01) |
| ***H01Q 21/28*** | (2006.01) |
| ***H01Q 5/385*** | (2015.01) |

(52) U.S. Cl.
CPC ..... *H01Q 9/065* (2013.01); *H01Q 21/005* (2013.01); *H01Q 21/28* (2013.01)

(58) Field of Classification Search
CPC ..... H01Q 1/1271; H01Q 1/48; H01Q 9/285; H01Q 21/062; H01Q 13/18; H01Q 9/27; H01Q 19/005; H01Q 1/42; H01Q 9/40; H01Q 13/085; H01Q 1/44; H01Q 21/065; H01Q 21/30; H01Q 9/065; H01Q 1/246; H01Q 5/335; H01Q 1/3275; H01Q 9/00; H01Q 1/243; H01Q 1/362; H01Q 21/0043; H01Q 21/28; H01Q 1/24; H01Q 21/0087; H01Q 9/42; H01Q 9/0421; H01Q 1/52; H01Q 9/38; H01Q 11/08; H01Q 9/0428; H01Q 13/106; H01Q 21/0075; H01Q 9/0414; H01Q 9/28; H01Q 1/36; H01Q 7/00; H01Q 5/00; H01Q 21/29; H01Q 9/14; H01Q 25/02; H01L 23/66
See application file for complete search history.

(56) References Cited

U.S. PATENT DOCUMENTS

| | | | | |
|---|---|---|---|---|
| 4,150,505 | A | 4/1979 | Voelker | |
| 4,218,682 | A * | 8/1980 | Frosch | H01Q 5/40 343/700 MS |
| 4,623,893 | A | 11/1986 | Sabban | |
| 4,972,196 | A | 11/1990 | Mayes et al. | |
| 5,121,127 | A * | 6/1992 | Toriyama | H01Q 5/40 343/700 MS |
| 5,349,365 | A | 9/1994 | Ow et al. | |
| 5,627,550 | A | 5/1997 | Sanad | |
| 5,657,028 | A | 8/1997 | Sanad | |
| 5,680,144 | A | 10/1997 | Sanad | |
| 6,008,762 | A | 12/1999 | Nghiem | |
| 6,020,852 | A * | 2/2000 | Jostell | H01Q 9/0435 343/864 |
| 6,114,996 | A | 9/2000 | Nghiem | |
| 6,160,512 | A | 12/2000 | Desclos et al. | |
| 6,239,750 | B1 * | 5/2001 | Snygg | H01Q 5/40 343/846 |
| 6,639,558 | B2 * | 10/2003 | Kellerman | H01Q 21/28 343/846 |
| 6,680,704 | B2 | 1/2004 | Cassel et al. | |
| 6,806,831 | B2 | 10/2004 | Johansson et al. | |
| 7,084,815 | B2 * | 8/2006 | Phillips | H01Q 5/40 343/846 |
| 7,116,323 | B2 | 10/2006 | Kaye et al. | |
| 7,116,324 | B2 | 10/2006 | Kaye et al. | |
| 7,202,818 | B2 * | 4/2007 | Anguera Pros | H01Q 9/0442 343/846 |
| 7,495,627 | B2 | 2/2009 | Parsche | |
| 7,498,989 | B1 * | 3/2009 | Volman | H01Q 25/001 343/846 |
| 7,706,458 | B2 | 4/2010 | Mody et al. | |
| RE43,294 | E | 4/2012 | Stuber et al. | |
| 8,373,597 | B2 | 2/2013 | Schadler | |
| 8,847,825 | B2 | 9/2014 | Schadler | |
| 8,952,851 | B1 | 2/2015 | Hsu et al. | |
| 8,982,008 | B2 | 3/2015 | Parsche | |
| 9,673,527 | B2 | 6/2017 | Yoon et al. | |
| 9,825,357 | B2 | 11/2017 | Parsche | |
| 9,825,373 | B1 | 11/2017 | Smith | |
| 9,843,102 | B2 | 12/2017 | Lai et al. | |
| 9,941,595 | B2 | 4/2018 | Yang et al. | |
| 9,966,658 | B2 | 5/2018 | Fitz-Coy et al. | |
| 10,128,572 | B2 | 11/2018 | Caratelli et al. | |
| 11,189,926 | B2 * | 11/2021 | Hwang | H01Q 9/0421 |
| 11,303,026 | B2 * | 4/2022 | Gimersky | H01Q 5/50 |
| 2017/0331186 | A1 | 11/2017 | Linn et al. | |
| 2018/0287260 | A1 | 10/2018 | Henry et al. | |
| 2019/0237873 | A1 | 8/2019 | Sazegar et al. | |

OTHER PUBLICATIONS

Stefano Maddio "A Circularly Polarized Antenna Array with a Convenient Bandwidth/Size Ratio Based on Non-Identical Disc Elements" Progress in Electromagnetics Research Letters, vol. 57, 47-54, 2015.

Hwangbo et al. "Millimeter-Wave Wireless Intra-/Inter Chip Communications in 3D Integrated Circuits Using Through Glass Via (TGV) Disc-Loaded Patch Antennas" 2016 IEEE 66th Electronic Components and Technology Conference (ECTC); Aug. 18, 1961; Abstract Only.

Ma et al. :Wideband circularly polarized single probe-fed patch antenna 2012 Wiley Periodicals, Inc. Microwave Opt Technol Lett 54:1803-1808, 2012 https://doi.org/10.1002/mop.26965; Abstract Only.

Punniamoorthy et al. "Design of Patch Antenna with Omni directional radiation pattern for wireless LAN applications" Proceeding International conference on Recent Innovations is Signal Processing and Embedded Systems (RISE-2017) Oct. 27-29, 2017; pp. 5.

L3Harris "RF-7800B-VU104—Land Mobile BGAN Terminal" 2020 L3Harris Technologies, Inc. | Jan. 2020 DS427H; pp. 2.

* cited by examiner

MICROSTRIP PATCH ANTENNA SYSTEM HAVING ADJUSTABLE RADIATION PATTERN SHAPES AND RELATED METHOD

TECHNICAL FIELD

The present disclosure relates to the field of communications, and, more particularly, to an antenna device and related methods.

BACKGROUND

The rockets that launch small satellites have limited space to store bus electronics and a projecting antenna. This limited space issue becomes technically challenging when the electronics and associated components include radio frequency (RF) assemblies operating with a reflector and mast extending outwardly from the reflector. For example, an antenna that includes a small reflector and mast operable in the Ka-band may have size constraints that make it difficult to incorporate amplifiers and other components, since the antenna and its associated reflector and mast are typically reduced in size. In some designs, it may be desirable to amplify RF signals at or close to the antenna, so that the amplifiers and associated components are to be incorporated into the smaller confined spaces associated with a reflector and mast.

Isoflux shaped antenna radiation patterns can be advantageous as they allow satellites to provide constant signal strengths throughout large earth coverage areas. An isoflux shaped radiation pattern is helpful for Low Earth Orbit (LEO) satellites to compensate for passage of the orbit and the wide slant range change due to earth curvature. For example, 10 dB or more of LEO radiation pattern shaping may be required. An LEO isoflux elevation plane radiation pattern may have a gain difference between the nadir and the horizon look angles of $G_n/G_h=10\ LOG_{10}(R_n/R_h)^2$, where G=Gain in dBi and $R_n$ and $R_h$ are the slant ranges at ground nadir and the earth horizon respectively. The power of two arises due to the rate of wave expansion loss with distance. So, for an LEO space antenna at 400 kilometers elevation, which corresponds to a slant range at the distant horizon of about 3647 kilometers, the radiation pattern gain straight down or at earth nadir may be $G=10\ LOG_{10}\ (400/3647)=-9.6$ dBi down relative the radiation pattern gain at the distant horizon look angles. So, in isoflux LEO, a shallow null is pointed straight down. Other factors may require even more deeply shaped radiation patterns to overcome foliage loss, jungle canopy or ground reflections, all of which degrade linking at the earth horizon.

In some existing satellite communications systems, a quadrifilar helix antenna may be used, for example, as disclosed in U.S. Pat. No. 5,349,365 to Ow. The quadrifilar helix may provide a selection of different radiation pattern shapes by varying the height to diameter ratio of the quadrifilar helix radiating structure. Many of those quadrifilar helix shapes may provide for isoflux radiation. In spite of these aspects, the quadrifilar helix may have some drawbacks. For example, the nonplanar design is less flexible in application deployment. In particular, it may be problematic to create vertical space in satellite launch housings for rigid embodiments. Compactable-deployable embodiments carry increased flight risk, and they are less desirable to some users. Moreover, the quadrifilar helix antenna may have no dual polarization, linear polarization, or separate Ex, Ey, Ez polarization channel capabilities. Also, this nonplanar antenna design may be expensive to build, and may have difficulty with proximity to ground planes.

Another approach is disclosed in U.S. Pat. No. 9,825,373 to Smith, which is assigned to the present application's assignee and is incorporated by reference in its entirety. This approach may also have drawbacks. Again, the nonplanar design lends to design difficulties. The design may also be expensive to manufacture, and may have less desirable omnidirectional pattern coverage. Also, the multiple resonant straight edges in this design may cause tolerance sensitivity.

The dipole turnstile approach according to U.S. Pat. No. 1,892,221, to Runge describes a pair of crossed wire dipoles operated over a ground plane. While the turnstile has found use, such as in broadcasting, instrumentation and other applications, the turnstile antenna is nonplanar, large in size, requires the complexity of a balun, with limited radiation pattern shaping, and does not provide access to an omni toroid pattern or Z axis polarization channel.

SUMMARY

Generally, an antenna device may include a ground plane, a first planar antenna element spaced above the ground plane and having an opening therethrough, and a second planar antenna element spaced above the first planar antenna element on a side of the first planar antenna element opposite the ground plane. The second planar antenna element may have a size smaller than the first planar antenna element. The antenna device may include a coaxial feed comprising an outer conductor and an inner conductor surrounded by the outer conductor and extending outwardly from an end of the outer conductor. The outer conductor may be coupled to the ground plane and the first planar antenna element. The inner conductor may extend through the opening in the first planar antenna element and may be coupled to the second planar antenna element.

More specifically, the first and second planar antenna elements may define a vertical axis, and the coaxial feed may be aligned along the vertical axis. The antenna device may comprise at least one additional coaxial feed spaced from the coaxial feed and having an inner conductor coupled to the first planar antenna element. The at least one additional coaxial feed may comprise first and second additional coaxial feeds spaced apart for different antenna polarizations.

In some embodiments, the antenna device may include a plurality of conductive pins coupled between the first and second planar antenna elements. The antenna device may comprise dielectric material between the ground plane and the first planar antenna element, and between the first planar antenna element and the second planar antenna element. For example, the dielectric material may comprise at least one of air and a dielectric foam.

Also, the first planar antenna element may have a circular shape with a diameter in a range of 0.45-0.55 wavelengths of an operational frequency. The second planar antenna element may also have a circular shape with a diameter in a range of 0.2-0.3 wavelengths of the operational frequency. The ground plane may also have a circular shape with a diameter greater than 0.45 wavelengths of the operational frequency.

Another aspect is directed to a satellite communications device comprising a wireless transceiver, and an antenna device coupled to the wireless transceiver. The antenna device may include a ground plane, a first planar antenna element spaced above the ground plane and having an opening therethrough, and a second planar antenna element spaced above the first planar antenna element on a side of the first planar antenna element opposite the ground plane. The second planar antenna element may have a size smaller than the first planar antenna element. The antenna device may include a coaxial feed comprising an outer conductor and an inner conductor surrounded by the outer conductor and extending outwardly from an end of the outer conductor. The outer conductor may be coupled to the ground plane and the first planar antenna element. The inner conductor may extend through the opening in the first planar antenna element and may be coupled to the second planar antenna element.

Yet another aspect is directed to a method for making an antenna device. The method may include positioning a first planar antenna element spaced above a ground plane and having an opening therethrough, and positioning a second planar antenna element spaced above the first planar antenna element on a side of the first planar antenna element opposite the ground plane. The second planar antenna element may have a size smaller than the first planar antenna element. The method may comprise positioning a coaxial feed comprising an outer conductor and an inner conductor surrounded by the outer conductor and extending outwardly from an end of the outer conductor so that the outer conductor is coupled to the ground plane and the first planar antenna element, and the inner conductor extends through the opening in the first planar antenna element and may be coupled to the second planar antenna element.

DETAILED DESCRIPTION

Figure 1:
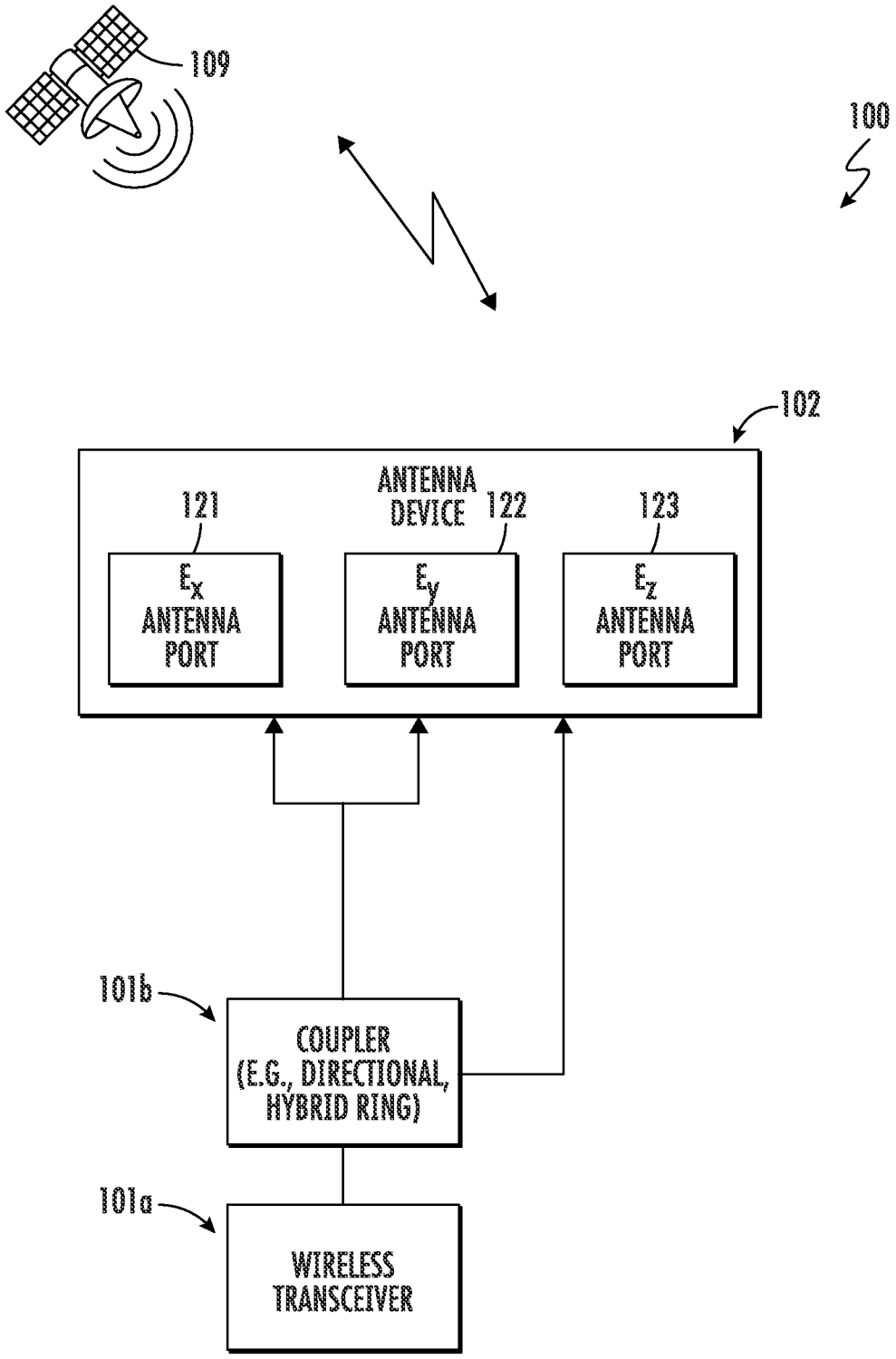
FIG. 1 is a schematic diagram of a satellite communications device, according to the present disclosure.
Figure 2:
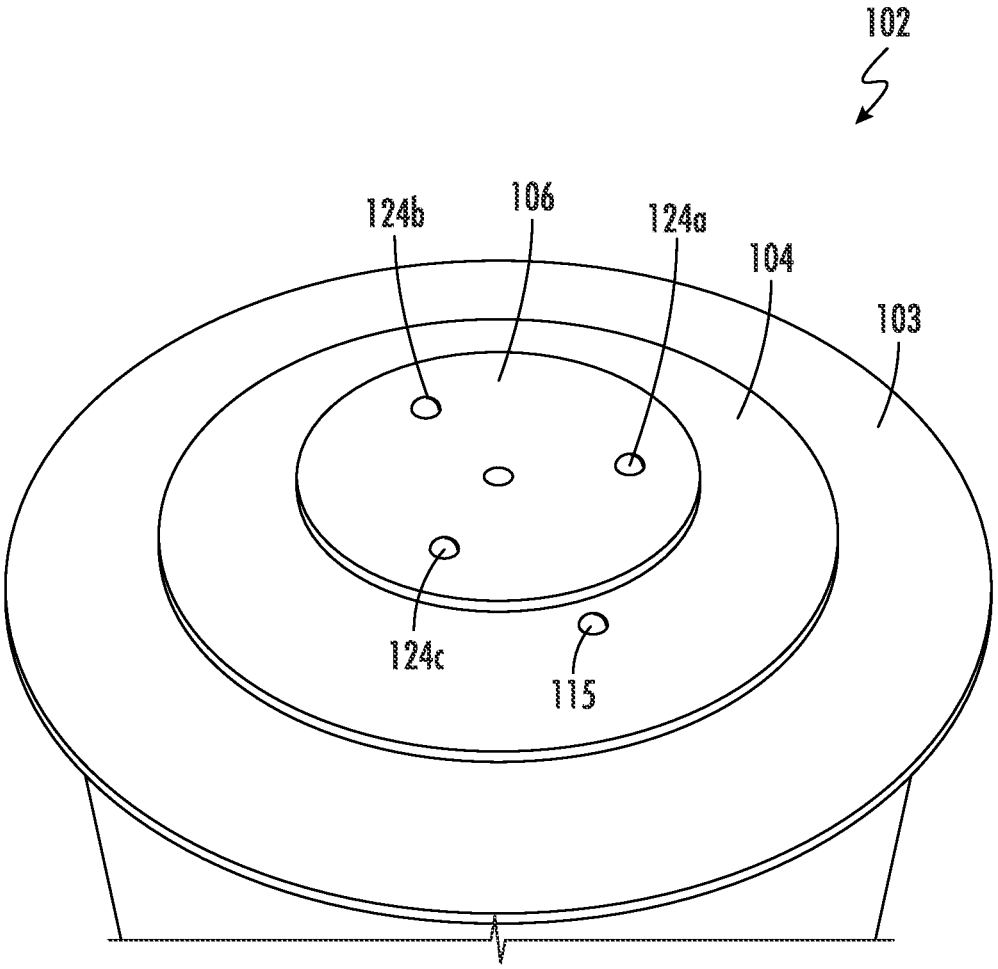
FIG. 2 is a top perspective view of an antenna device from a first embodiment of satellite communications device of FIG. 1.
Figure 3:
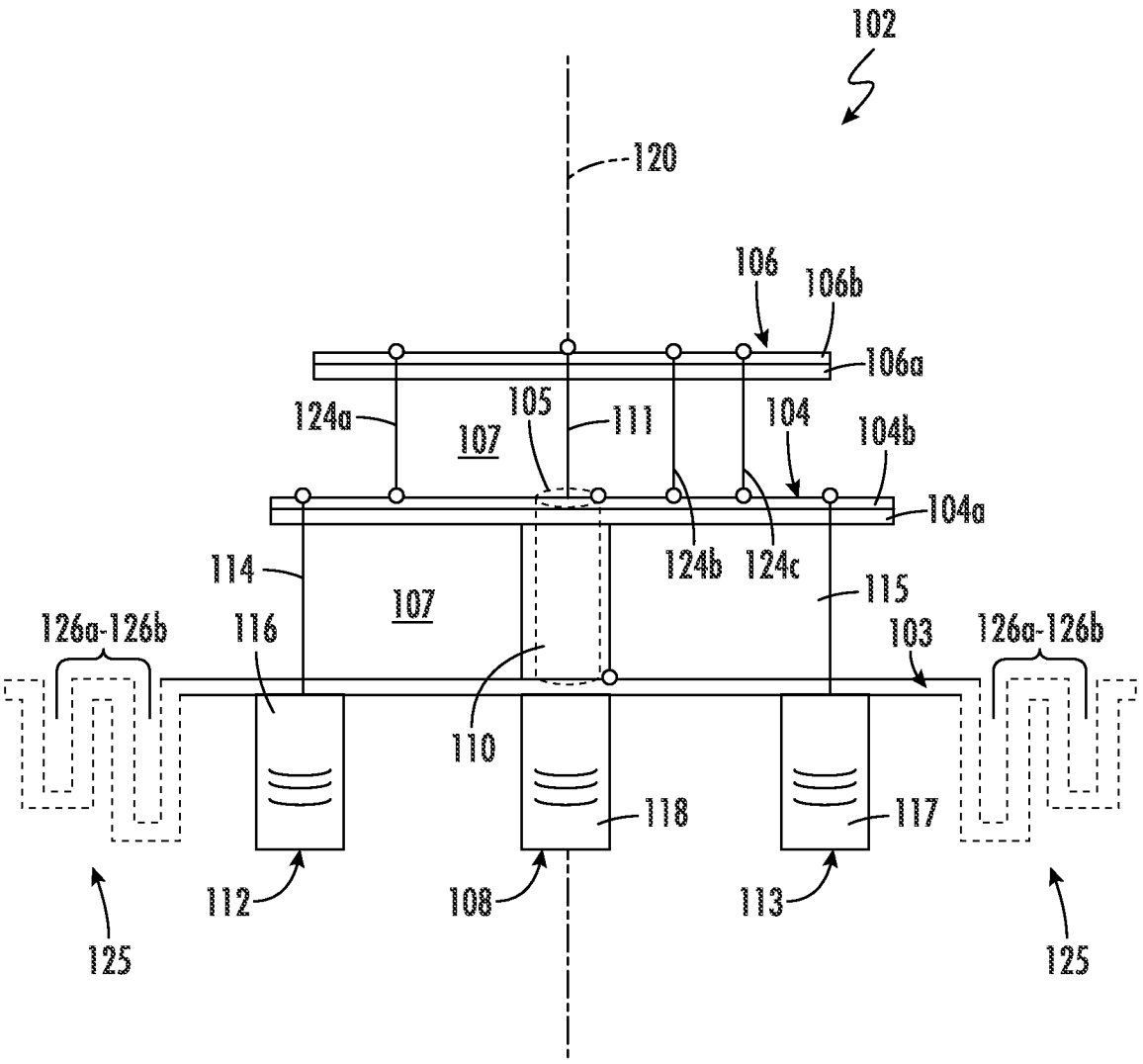
FIG. 3 is a side view of another embodiment of the antenna device from FIG. 2 with a pattern shaping portion.

The present disclosure will now be described more fully hereinafter with reference to the accompanying drawings, in which several embodiments of the invention are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout, and base 100 reference numerals are used to indicate similar elements in alternative embodiments.

Referring initially to FIGS. 1-4, a satellite communications device 100 according to the present disclosure is now described. The satellite communications device 100 may overcome the problems of typical antenna approaches.

The satellite communications device 100 illustratively comprises a wireless transceiver 101*a*, a coupler 101*b* coupled downstream from the wireless transceiver, and an antenna device 102 coupled downstream from the coupler. For example, the coupler 101*b* may comprise one or more of a directional coupler, and a hybrid ring.

As will be appreciated, the satellite communications device 100 illustratively comprises, for example, a satellite device on a ground based or an airborne vehicle, in communication with a satellite device 109. The satellite device 109 may comprise an LEO satellite, a Medium Earth Orbit (MEO) satellite, a High Earth Orbit (HEO) satellite, or a HEO geosynchronous satellite. In other embodiments, the antenna device 102 may be alternatively or additionally deployed within the satellite device 109.

The antenna device 102 illustratively includes a ground plane 103. The ground plane 103 may comprise one or more of brass, aluminum, copper, or steel. In applications where the antenna device 102 is deployed in a vehicle application, the vehicle body may provide the ground plane 103 (i.e. the ground plane is integrated with the vehicle). The antenna device 102 includes a first planar antenna element 104 spaced above the ground plane 103 and having an opening 105 therethrough. The first planar antenna element 104 comprises a dielectric layer 104*a* (e.g. printed circuit board), and an electrically conductive layer 104*b* (e.g. brass, aluminum, copper, silver, or steel) carried by the dielectric layer.

The antenna device 102 includes a second planar antenna element 106 spaced above the first planar antenna element 104 on a side of the first planar antenna element opposite the ground plane 103. The second planar antenna element 106 comprises a dielectric layer 106*a* (e.g. printed circuit board), and an electrically conductive layer 106*b* (e.g. brass, aluminum, copper, silver, or steel) carried by the dielectric layer.

The second planar antenna element 106 has a size smaller than the first planar antenna element 104. Also, the first planar antenna element 104, the second planar antenna element 106, and the ground plane 103 each illustratively has a circular shape. Indeed, each of the circular shaped first planar antenna element 104, the circular shaped second planar antenna element 106, and the circular shaped ground plane 103 are parallel and concentric. Of course, each of the circular shaped first planar antenna element 104, the circular shaped second planar antenna element 106, and the circular shaped ground plane 103 may be substantially parallel (i.e. ±15° of parallel) and substantially concentric (i.e. ±5% of concentric). In other embodiments, the first planar antenna element 104, the second planar antenna element 106, and the ground plane 103 may have other polygonal shapes, such as a square-shape or rectangle-shape, for example.

In the illustrated embodiment, the first planar antenna element 104 may have a diameter in a range of 0.45-0.55 wavelengths of an operational frequency. The second planar antenna element 106 may have a diameter in a range of 0.2-0.3 wavelengths of the operational frequency. The ground plane 103 may have a diameter greater than 0.45 wavelengths of the operational frequency. As will be appreciated, the size of and spacing therebetween of the first planar antenna element 104, the second planar antenna element 106, and the ground plane 103 may be adjusted to change bandwidth of the antenna device 102.

The antenna device 102 illustratively includes a pattern shaping portion 125 surrounding the ground plane 103 and comprising a pair of corrugations 126*a*-126*b*. The pattern shaping portion 125, when present (i.e. being an optional feature noted with dashed lines), reduces radiation behind the antenna device 102 and in some instances adjusts radiation that is coplanar to the antenna device. The antenna device 102 illustratively comprises dielectric material 107 between the ground plane 103 and the first planar antenna element 104, and between the first planar antenna element and the second planar antenna element 106. For example, the dielectric material 107 may comprise at least one of air and a dielectric foam, or a solid dielectric material, such as Teflon. The diameter of the first planar element 104 is given by $d=0.51\lambda/\sqrt{(\varepsilon_r\mu_r)}$, where $\lambda$=the free space wavelength, $\varepsilon_r$ is the relative permittivity of the dielectric material 107, and $\mu_r$ is the relative permittivity of the dielectric material 107 (if any).

The antenna device 102 illustratively comprises a coaxial feed 108 comprising an outer conductor 110, an inner conductor 111 surrounded by the outer conductor and extending outwardly from an end of the outer conductor, and an insulating sheath 118 surrounding the outer conductor. The outer conductor 110 is coupled to the ground plane 103 and the first planar antenna element 104. The inner conductor 111 extends through the opening 105 in the first planar antenna element 104 and is coupled to the second planar antenna element 106.

The antenna device illustratively includes a first additional coaxial feed 112, and a second additional coaxial feed 113, each being spaced from the coaxial feed 108. Each of the first additional coaxial feed 112 and the second additional coaxial feed 113 illustratively comprises an inner conductor 114, 115 coupled to the electrically conductive layer 104*b* of the first planar antenna element 104, and an insulating sheath 116, 117 surrounding the inner conductor. The first additional coaxial feed 112 and the second additional coaxial feed 113 are spaced apart for different antenna polarizations. For example, the different antenna polarizations may comprise an x polarization, a y polarization, and a z polarization.

Although the illustrated antenna device 102 comprises the coaxial feed 108, the first additional coaxial feed 112, and the second additional coaxial feed 113, some embodiments may operate with less feeds. For example, the coaxial feed 108 may be the only feed, causing the antenna device 102 to operate as a half-wave dipole. Alternatively, the coaxial feed 108 may be omitted in exchange for only using the first additional coaxial feed 112 and the second additional coaxial feed 113 to provide broadside radiation directive patterns.

More specifically, the first and second planar antenna elements 104, 106 define a vertical axis 120. The coaxial feed 108, the first additional coaxial feed 112, and the second additional coaxial feed 113 may be aligned along the vertical axis. For example, in the illustrated embodiment, the coaxial feed 108, the first additional coaxial feed 112, and the second additional coaxial feed 113 are substantially parallel (±15° from parallel) to the vertical axis 120.

Figure 4:
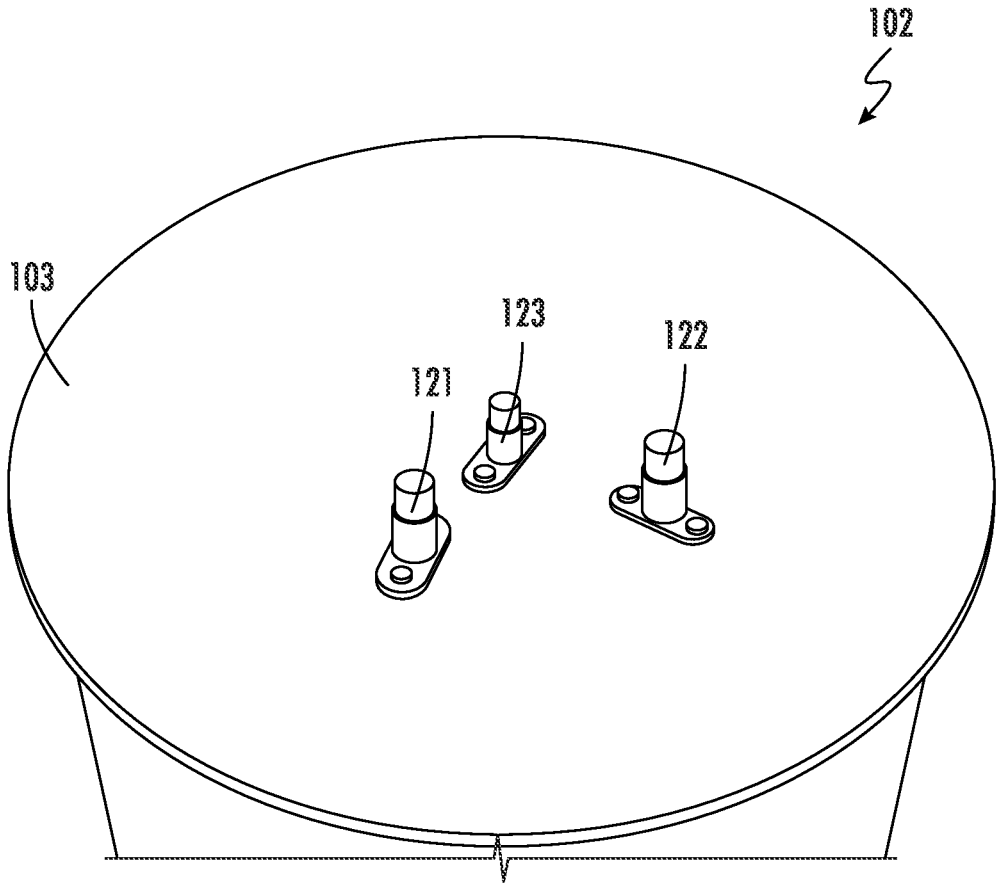
FIG. 4 is a bottom perspective view of the antenna device from FIG. 2.
Figure 5A:
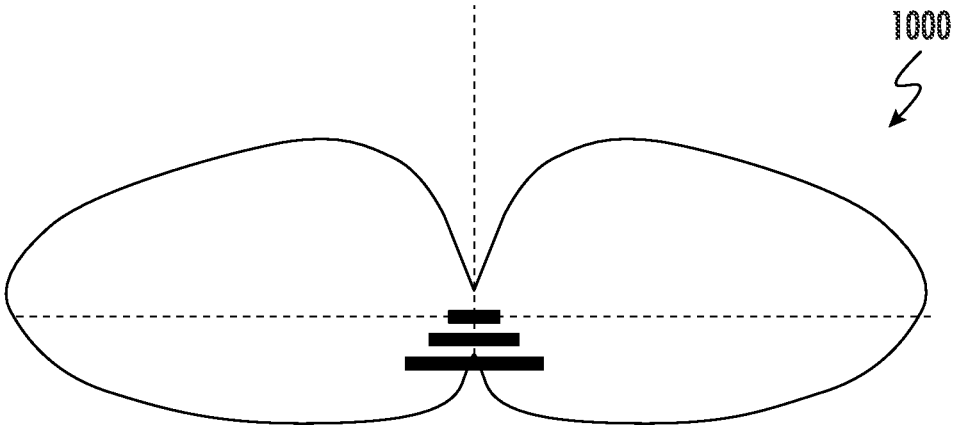
FIGS. 5A-5B are diagrams of radiation patterns for the antenna device from FIG. 2.
Figure 5B:
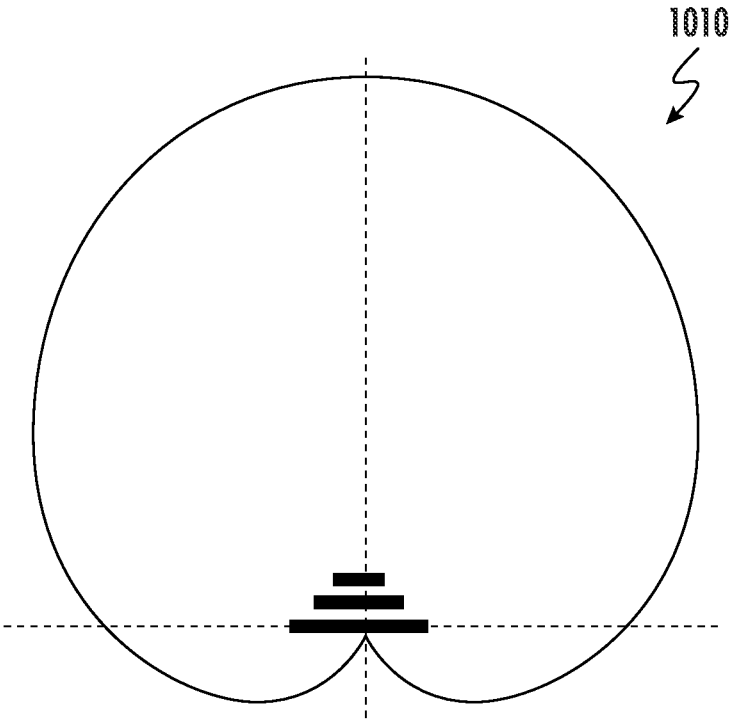

As perhaps best seen in FIG. 4, each of the coaxial feed 108, the first additional coaxial feed 112, and the second additional coaxial feed 113 illustratively includes a connection port 121, 122, 123. In the illustrated embodiment, the connection ports 121, 122, 123 each comprises a coaxial female connector. For example, the connection ports 121, 122, 123 may respectively define an x polarization port, a y polarization port, and a z polarization port.

In the illustrated embodiments, the antenna device 102 includes a plurality of conductive pins 124*a*-124*c* coupled between the first and second planar antenna elements 104, 106. The plurality of conductive pins 124*a*-124*c* may comprise one or more electrically conductive materials, such as brass, copper, aluminum, or silver. Each of the plurality of conductive pins 124*a*-124*c* is electrically coupled to the electrically conductive layers 104*b*, 106*b* of the first and second planar antenna elements 104, 106. As will be appreciated, the respective locations of the plurality of conductive pins 124*a*-124*c* may be adjusted to control the driving resistance of the second planar antenna element 106.

The first planar antenna element 104 comprises a broadside firing antenna element with a Bessel zero resonance disc providing Ex and Ey polarizations (connection ports 121, 122) and cosine patterns. The second planar antenna element 106 provides a coplanar firing/omni toroid radiation pattern antenna element with a fundamental resonance disc providing Ez polarization and a sine pattern.

In embodiments where the coupler 101*b* comprises a directional coupler and a downstream hybrid ring coupler, the power to the first and second planar antenna elements 104, 106 is varied by selecting the coupling coefficient of the directional coupler. For example, if more radiation is needed on the horizon, a higher coupling coefficient directional coupler is used and applies more power to the coplanar radiating second planar antenna element 106. If more radiation at broadside is needed, a lower coupling coefficient directional coupler is used so more power goes to the first planar antenna element 104. In such an embodiment, the elevation plane radiation pattern is shaped. The azimuth radiation pattern in this embodiment would be all directional/omnidirectional. The adjustable radiation pattern shape provides a method to accomplish isoflux radiation from or to an aircraft or earth satellite as for instance the antenna gain may be reduced in the direction of shorter transmission distance and increased in the direction of greater transmission. An LEO satellite application may have a partial null realized straight down towards the earth with a 10 to 20 decibels of gain reduction at that look angle, and an increased gain towards the coverage area where the slant range is larger. Also, coaxial cable lengths leading to the coaxial feeds 112, 113, 108 may be unequal in order to adjust excitation phase to the first and second planar antenna elements 104, 106 as an additional means for radiation pattern shaping.

Yet another aspect is directed to a method for making the antenna device 102. The method includes positioning a first planar antenna element 104 spaced above a ground plane 103 and having an opening 105 therethrough, and positioning a second planar antenna element 106 spaced above the first planar antenna element on a side of the first planar antenna element opposite the ground plane. The second planar antenna element 106 has a size smaller than the first planar antenna element 104. The method comprises positioning a coaxial feed 108 comprising an outer conductor 110 and an inner conductor 111 surrounded by the outer conductor and extending outwardly from an end of the outer conductor so that the outer conductor 110 is coupled to the ground plane 103 and the first planar antenna element 104, and the inner conductor 111 extends through the opening 105 in the first planar antenna element 104 and is coupled to the second planar antenna element 106.

While the antenna device 102 is not so limited, parameters of an example implementation of the antenna device 102 are presented in Table 1:

TABLE 1

Parameters of an Example Implementation of the Antenna Device

| Parameter | Value | Comments |
|---|---|---|
| Frequency of operation | 1575.42 MHz | |
| Conductive ground plane 103 material | 0.020 inch thick FR4 printed circuit board | Could be sheet metal |
| Diameter of conductive ground plane 103 | 5.800 inches | May be varied |
| Pattern shaping portion 125 | Not present this example | |
| Diameter of conductive first planar antenna element 104 | 3.900 inches | Sets frequency of operation |
| Diameter of conductive second planar antenna element 106 | 2.180 inches | Sets frequency of operation |
| First planar antenna element 104, second planar antenna element 106 material | 0.020 inch thick FR-4 printed circuit board | Could be sheet metal as well |
| Distance between top surface of ground plane to bottom surface of conductive first planar antenna element 104 | 0.375 inches | |
| Distance between top surface of ground plane and bottom surface of conductive second planar antenna element 106 | 0.759 inches | |
| Location of inner conductor 114/the X polarization port | x = 1.100, y = 0.00 inches | |
| Location of inner conductor 115/the Y polarization port | X = 0.000, y = 1.100 inches | |
| Diameter of inner conductor 114, 115 | 0.050 inches | Brass material |
| Pin 124a-124c location | 0.310 inches out from center, spaced every 120 degrees | Spacing from center adjusts resistance |
| Conductive pin 124a-124c diameter | 0.030 inches | Brass |
| Outer conductor 110 | 0.085 inches outer diameter | Outer conductor 110 is a segment of coaxial feed 108 |
| Coaxial feed 108 | RG-405 coaxial cable | $Z_0$ = 50 ohms |

Referring now to FIGS. 5A-5B, 6, 7A-7D, 8A-8C, and 9A-9B, diagrams 1000, 1010, 1015, 1045, 1050, 1060, 1070, 1080, 1090, 1100, 1110, 1120 demonstrate performance of an exemplary embodiment of the antenna device 102. Diagram 1000 shows an isoflux constant signal strength pattern for an LEO satellite. Diagram 1010 shows an isoflux constant signal strength pattern for an HEO/geostationary satellite.

Figure 6:
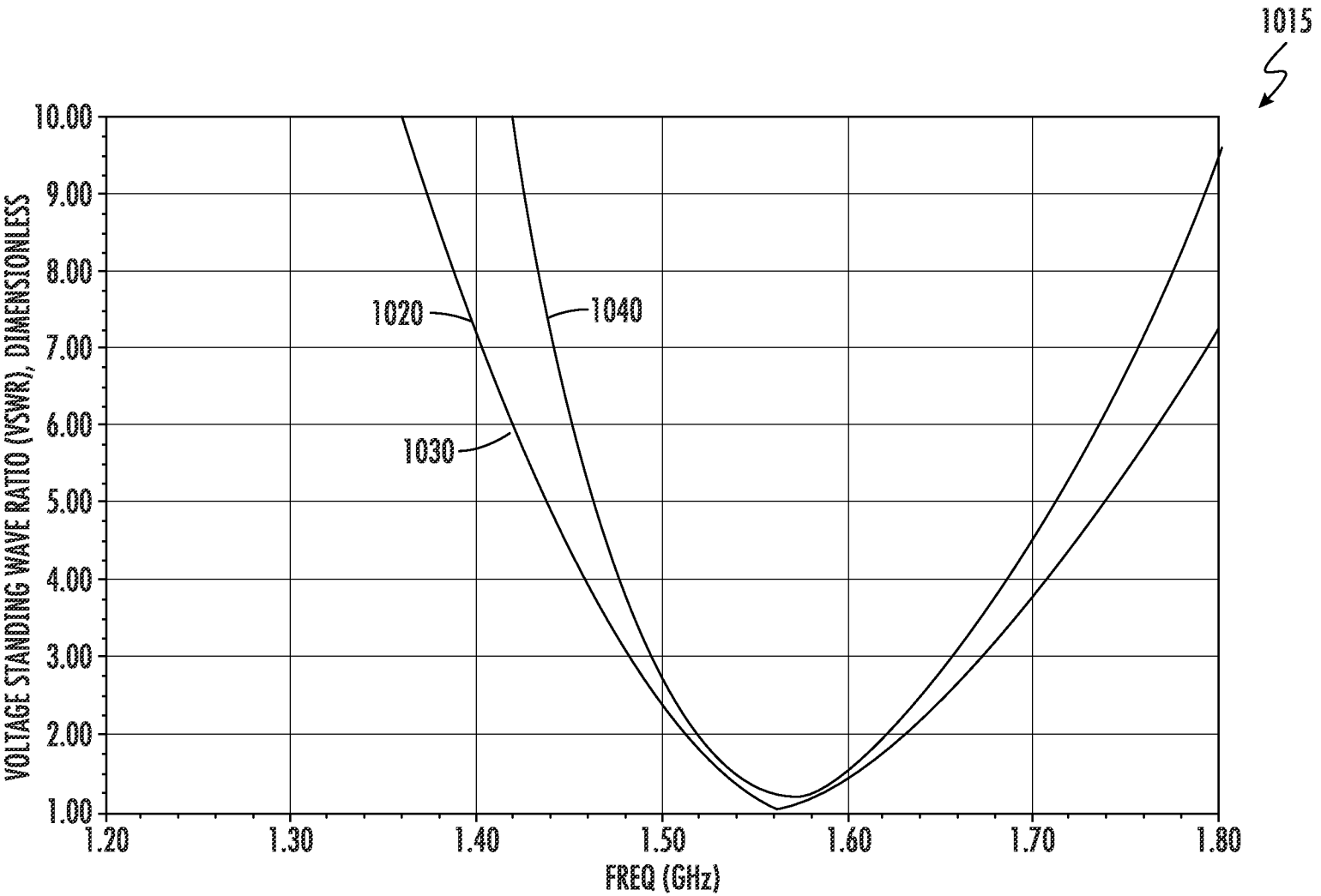
FIG. 6 is a diagram of voltage standing wave ratio (VSWR) for the antenna device from FIG. 2.

Referring specifically to diagram 1015 of FIG. 6, traces 1020, 1030, 1040 show that the VSWR of the example implementation of the antenna device 102 using Table 1 dimensions that is tuned and matching respectively at the connection ports 121, 122, 123 (x, y, z). Trace 1020 is the VSWR at the X polarization connection port 121; trace 1030 is the VSWR at the Y polarization connection port 122; and trace 1040 is the VSWR at the Z polarization connection port 123. Traces 1020, 1030 are on top of each other or nearly so. As can be seen, a quadratic frequency response is provided. The VSWR dips below 1.2 to 1 at all three connection ports at midband. 2 to 1 VSWR bandwidth at all three of connection ports 121, 122, 123 is 7 percent. Although this instance was for a 50 ohm system, a wide range of connection port impedances may also be accomplished including 50 ohms resistive. All three of the connection ports 121, 122, 123 exhibited a 3 dB realized gain bandwidth of 19 percent.

Diagram 1045 is a radiation pattern coordinate system for the antenna device 102. Diagrams 1050, 1060, 1070 are the XY, YZ and ZY cut far field radiation patterns with various ratios of RF power applied to show that the antenna device 102 can provide a range of isoflux radiation pattern shapes. Diagram 1050, 1060, 1070 radiation patterns are elevation cuts in which phi is held constant at $\Phi$=45° and theta is varied from $\theta$=0 to 360° degrees. The plotted quantity is total fields, and the units are realized gain in decibels with respect to an isotropic antenna (dBi). The pattern shapes are adjusted by using selected amplitude and phases at the connection ports 121, 122, 123 (x, y, z). Also, the back lobe or downwards radiation portion can be adjusted by changing the diameter of the first planar antenna element 104 or by inclusion of the pattern shaping portion 125. For the radiation pattern shown in diagram 1050 (i.e. modified cosinen pattern for geosynchronous application), the first planar antenna element 104 is fed simultaneously with: a 0.5 volt signal at 0° phase via the first additional coaxial feed 112; a 0.5 volt signal at −90° phase via the second additional coaxial feed 113; and the second planar antenna element 106 is fed a 0 volt signal via the coaxial feed 108.

For the radiation pattern shown in diagram 1060 (i.e. cardioid for MEO or LEO applications): the first planar antenna element 104 is fed simultaneously with: a 0.08 volt signal at 0° phase via the first additional coaxial feed 112; a 0.08 volt signal at −90° phase via the second additional coaxial feed 113; and the second planar antenna element 106 is fed a 0.84 volt signal at 0° phase via the coaxial feed 108. For the radiation pattern shown in diagram 1070 (i.e. a sine$^n$ or "omni toroid" pattern for say ground to air or land mobile), the first planar antenna element 104 is fed simultaneously with: a 0 volt signal at 0° phase at first additional coaxial feed 112; a 0 volt signal at second additional coaxial feed 113; and the second planar antenna element 106 is fed a 1 volt signal at 0° phase at the coaxial feed 108.

In diagrams 1050, 1060, 1070, the conductive pins 124*a*, 124*b*, 124*c* of the antenna device 102 are considered. Diagrams 1080, 1090, 1100 show radiation patterns for the antenna device 102 respectively at the connection ports 121, 122, 123 (x, y, z), driven individually as a system of three separate channels. In diagram 1080, the square hatched plot represents gain at midband (1 GHz in this instance) with 0° of phase; the circle hatched plot represents gain at midband with 44° of phase; and the solid plot represents gain at with 90° of phase. In diagram 1090, the square hatched plot represents gain at midband with 0° of phase; the circle hatched plot represents gain at midband with 44° of phase; and the solid plot represents gain at midband with 90° of phase. In diagram 1100, the square hatched plot represents gain at midband with 0° of phase; the circle hatched plot represents gain at midband with 44° of phase; and the solid plot represents gain at midband with 90° of phase.

Here, the connection ports 121, 122 radiate away from the first planar antenna element 104, providing the two orthogonal X and Y polarization components. The last connection port 123 radiates to the side with the final Z polarization component. The connection ports 121, 122 (X and Y) provide cosine θ shape approximations, and the connection port 123 (Z) is the complimentary sine Φ approximation. As will be appreciated, the z polarization component cannot be radiated at the first planar antenna element 104. Diagram 1110 shows that the antenna device 102 provides a useful port to port isolation (S21) respectively between: connection ports 121, 122 (x, y), as trace 1111; connection ports 122, 123 (y, z), as trace 1112; and connection ports 123, 121 (z, x), as trace 1113. Traces 1112 and 1113 are nearly the same and on top of each other in the graph. Diagram 1120 includes: a trace 1115 showing the port to port phase (S21) between connection ports 121, 122 (x, y); a trace 1116 shows the port to port phase (S21) between connection ports 122, 123 (y, z) and trace 1117 shows the port to port phase (S21) between 123, 121 (z, x).

Advantageously, the antenna device 102 is quite flexible in operation. The illustrated embodiment can provide an x polarization port, a y polarization port, and a z polarization respectively at the connection ports 121, 122, 123. In the following, other embodiments with different polarizations are discussed. Moreover, the planar shape of the antenna device 102 makes packaging easier in space constrained applications, such as an airborne satellite device. As shown above, the antenna device 102 provides isoflux constant signal strength radiation patterns for both LEO and HEO applications. Indeed, the antenna device 102 can provide complimentary radiation patterns (i.e. sine and cosine), omnidirectional radiation patterns, unidirectional radiation patterns, and radiation pattern shapes in between.

A theory of operation for the antenna device 102 will now be described. Starting from the bottom up, the ground plane 103 acts as an image plane to the first antenna element 104 so a virtual mirror image of the first antenna element and an apparent second source of radio waves is located an equal distance under the ground plane 103. The ground plane 103 diameter somewhat adjusts the radiation pattern beamwidth of the first antenna element 104 and a minimum first antenna element beamwidth may occur for a ground plane radius of λ/2. The ground plane 103 is in general not a resonant structure, so its diameter may be varied without changing frequency of operation.

The pair of corrugations 126*a*-126*b*, if present, acts to cause a high impedance to the flow of RF electric currents on the ground plane 103 surface, which in turn suppresses the conveyance of surface waves on the surface of the pattern shaping portion 125. The wave diffraction around the ground plane 103 rim is reduced and radiation in the half space below the ground plane 103 may thus be regulated to a level desired.

Continuing the theory of operation and moving to the first antenna element 104. The charge separation between the ground plane 103 and the first antenna element 104 conductive pins 124*a*, 124*b*, 124*c* creates a slot antenna at the rim of the first antenna element 104. Further, the radial transmission line provided by the bottom surface of the first antenna element 104 provides a uniform current distribution at the first antenna element rim. Also, the radiation of the antenna element 104 is thus near 130 ohms regardless of how close the first antenna element 104 is to the ground plane 103. The 100 plus ohm radiation resistance at the first antenna element 104 edge is transformed to a driving resistance of 50 ohms (or otherwise) at the inner conductor 114, 115 by adjustment of the position of the inner conductors, in and out from the first antenna element center, as a radial microstrip transmission line current moding that exists on the bottom of the first antenna element and the adjacent surface of the ground plane 103 under the first antenna element.

In circular polarization operation, the first antenna element 104 carries a traveling wave current flow around the first antenna element periphery. The inner conductors 114, 115 in the region between ground plane 103 and first antenna element 104 function as probes to convey RF currents and separate electrical charge between the ground plane 103 and first antenna element 104. The outer conductor 110, which extends between the ground plane 103 and the first antenna element 104, is not electrically active in the operation of antenna first antenna element 104 and little to no RF current is conveyed on the outer conductor 110 exterior. The radiating mode for the first antenna element 104 is primarily transmission mode. The radiation pattern of the first antenna element 104 is mostly directed broadside the first element plane and modified cosine in shape.

Figure 7A:
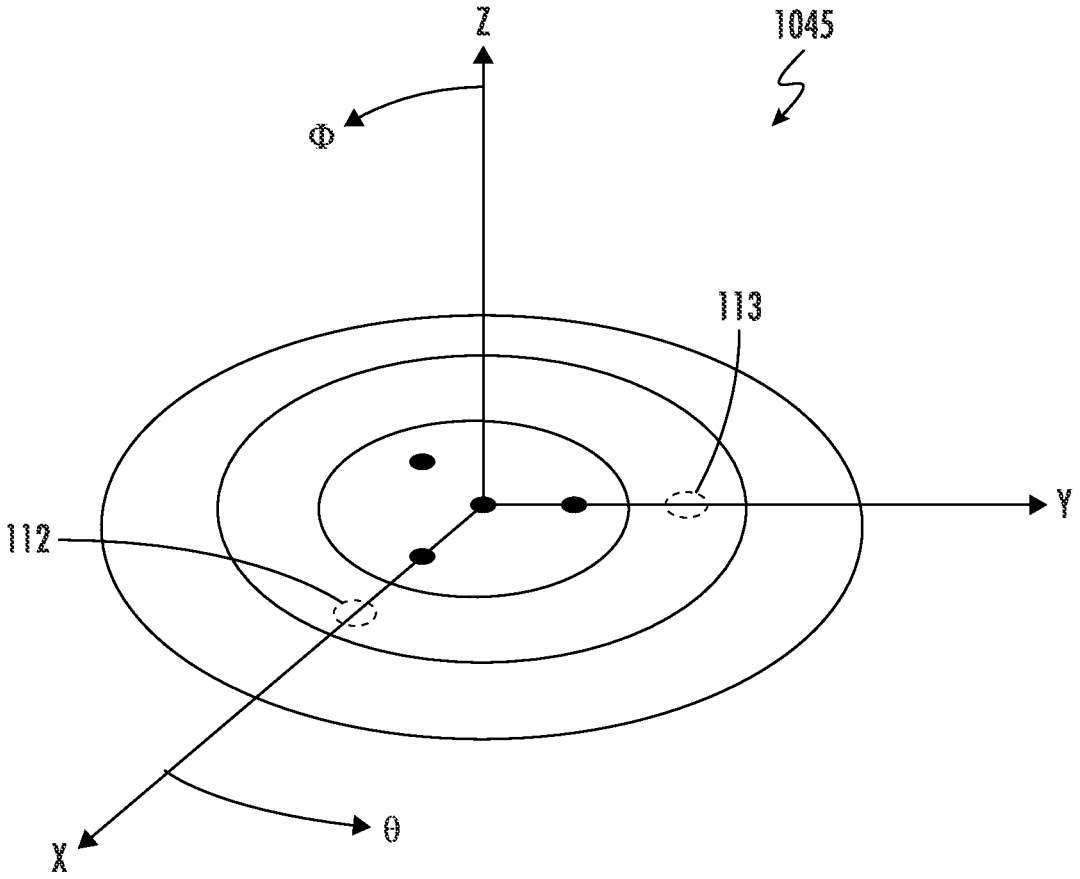
FIG. 7A is a radiation pattern coordinate system for the antenna device of FIG. 2.
Figure 7B:
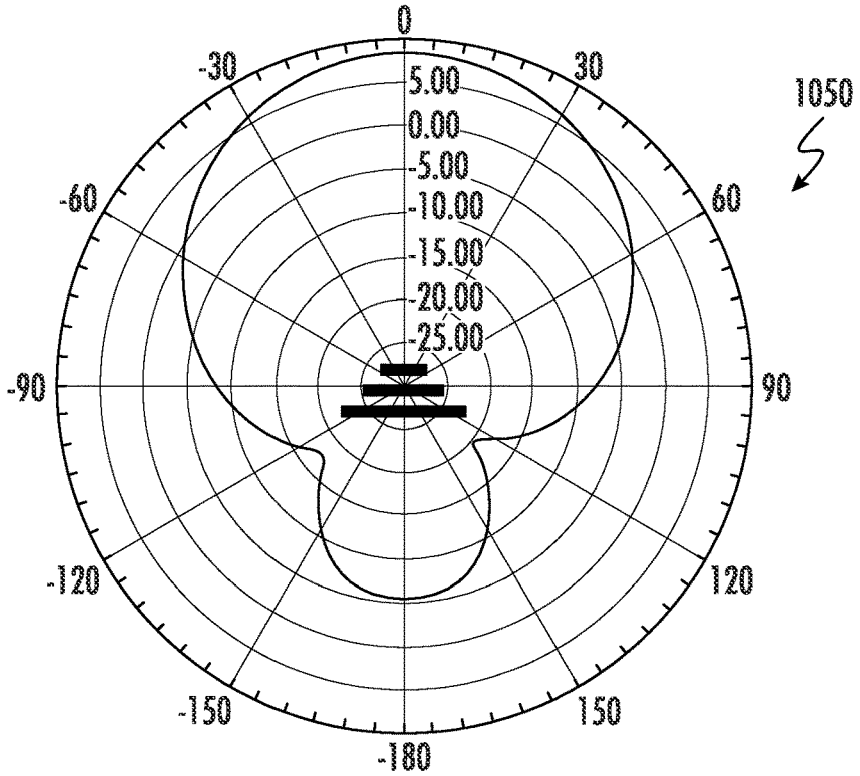
FIGS. 7B-7D are diagrams of isoflux radiation patterns for the antenna device from FIG. 2.
Figure 7C:
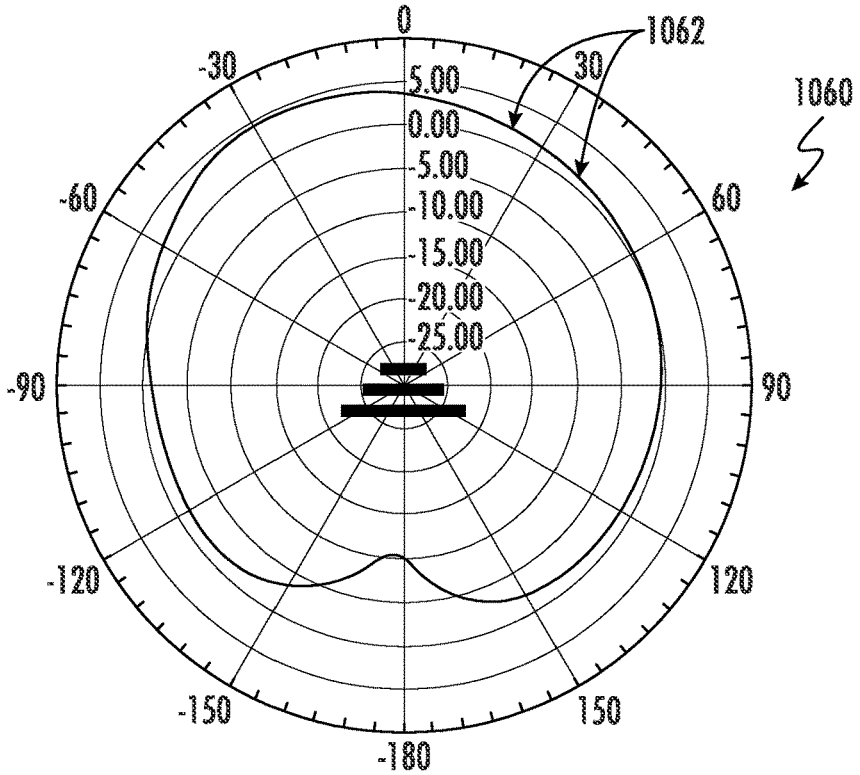
Figure 7D:
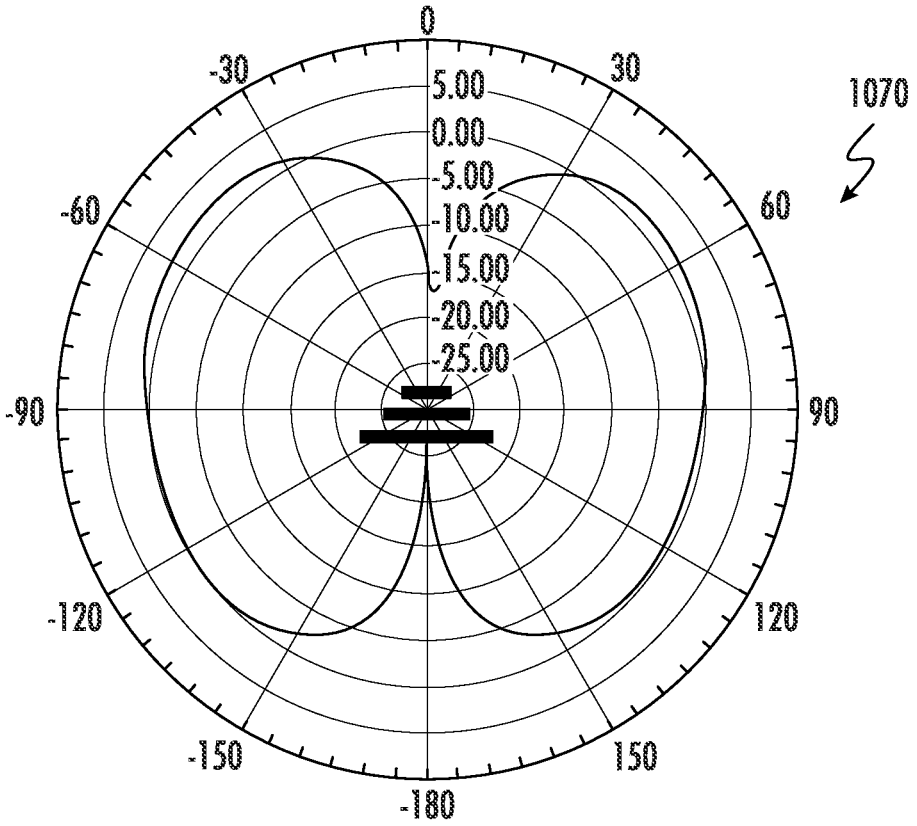
Figure 8A:
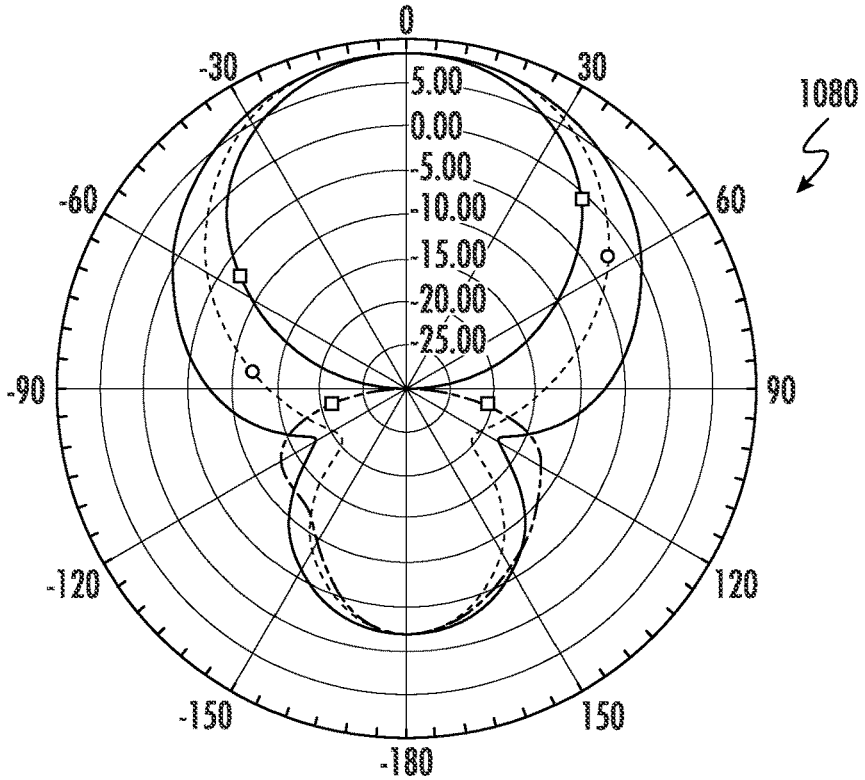
FIGS. 8A-8C are diagrams of radiation patterns for the antenna device from FIG. 2 from individual coaxial feeds.
Figure 8B:
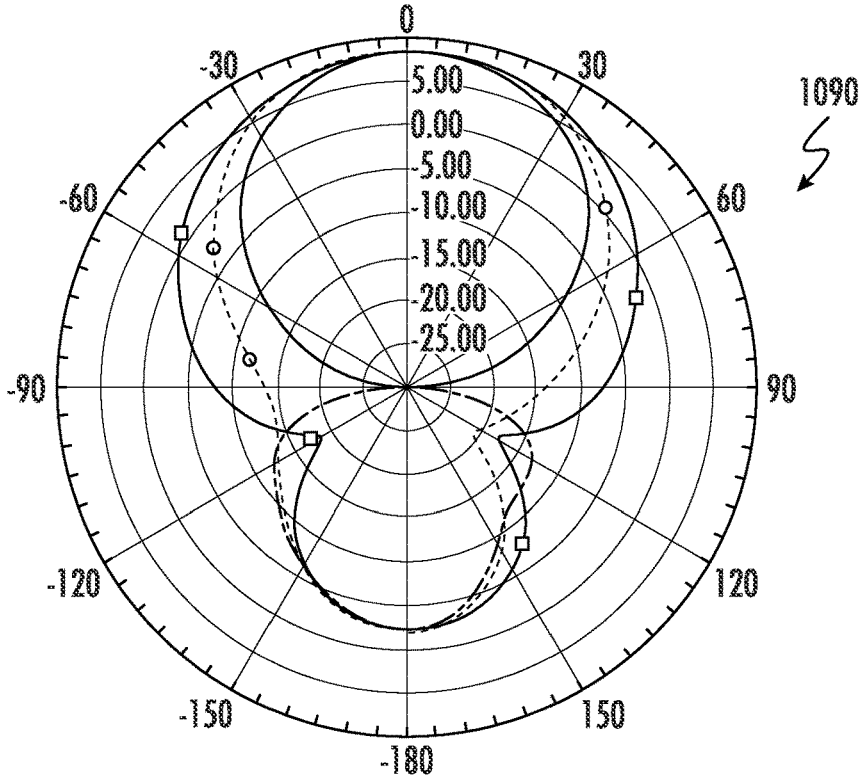
Figure 8C:
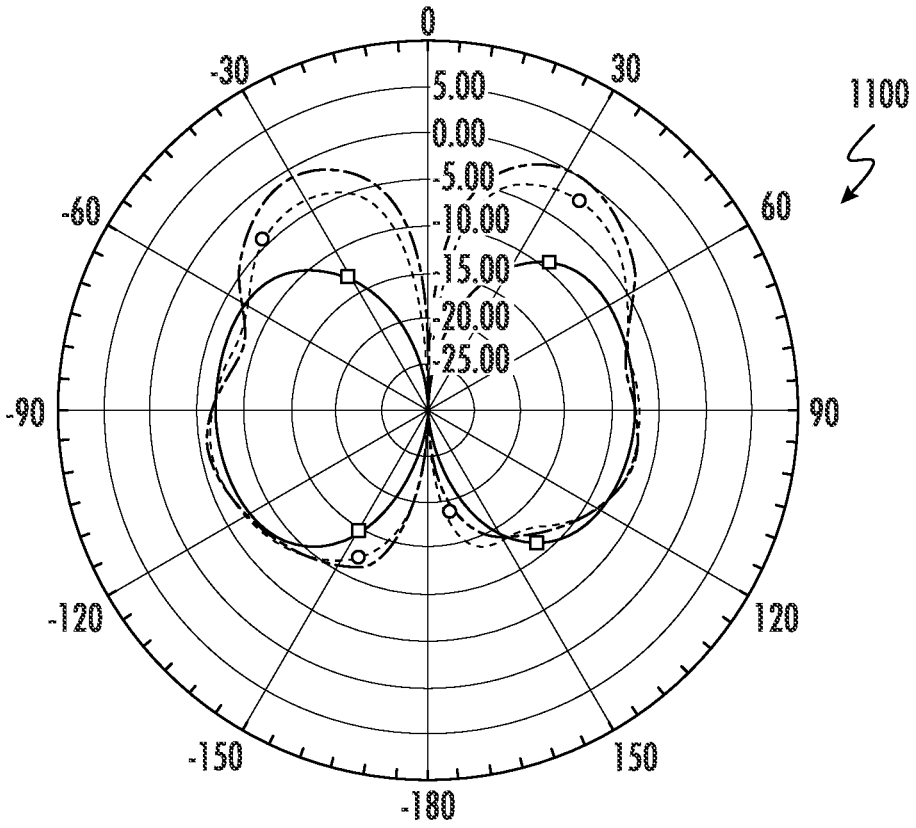
Figure 9A:
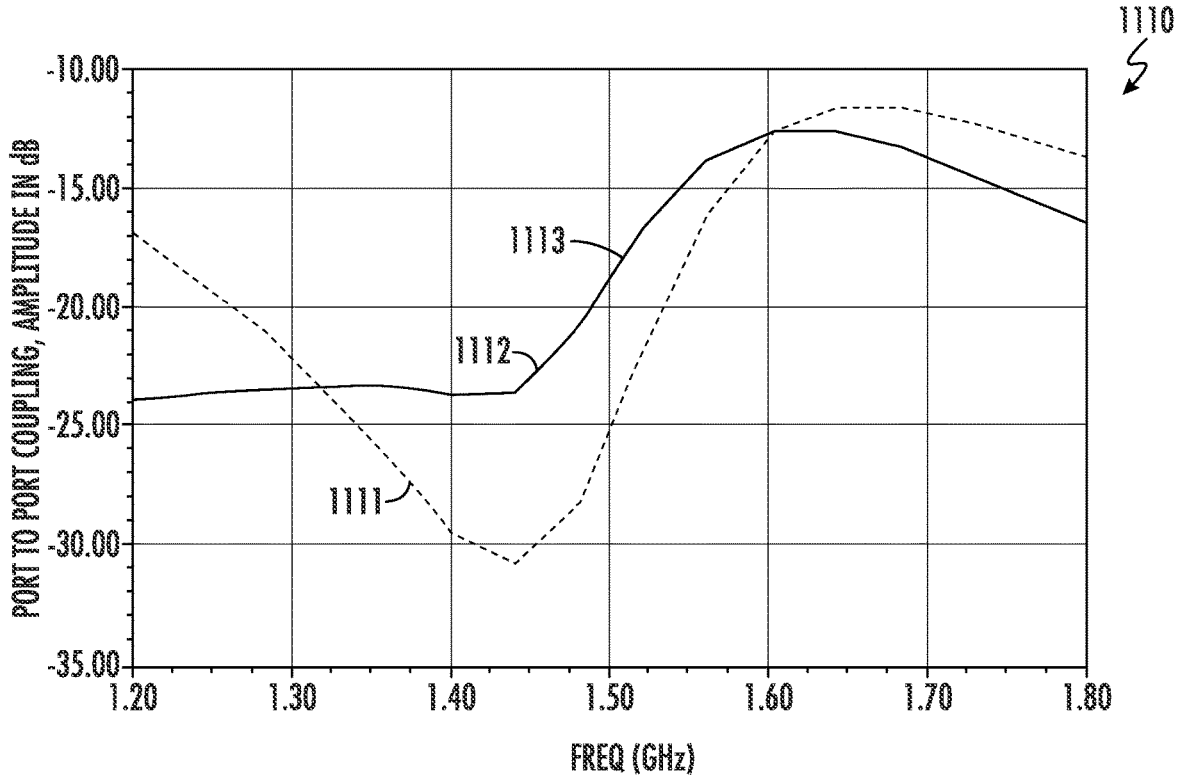
FIGS. 9A-9B are diagrams of antenna port isolation for the antenna device from FIG. 2.
Figure 9B:
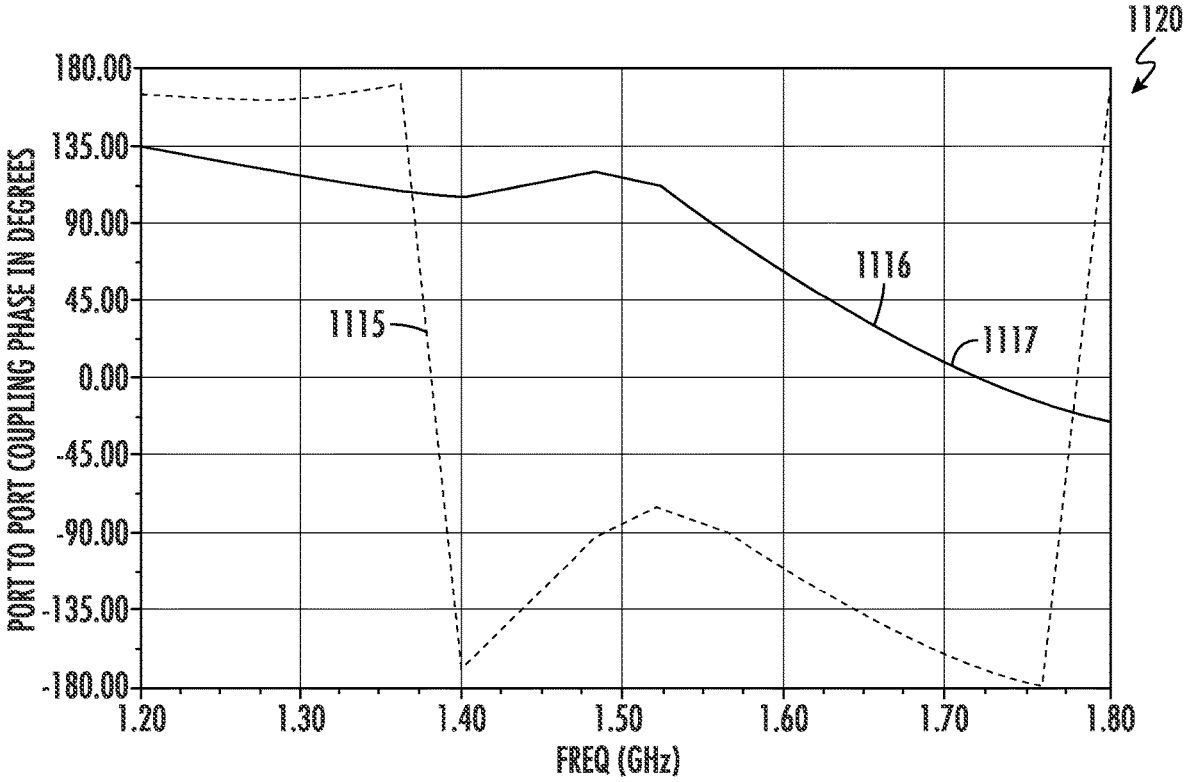

Increasing relative permittivity of the dielectric layer 104*a* increases first antenna element beamwidth slightly. Referring to FIG. 7C, shallow null 1062 may be present in the elevation cut radiation patterns. It is caused by radiation from the conductive pins 124*a*, 124*b*, 124*c*. This radiation can be eliminated if desired by a second set of conductive pins positioned 180 degrees around the antenna as described by U.S. Pat. No. 9,825,357 to Parsche, which is assigned to the present application's assignee, the entire contents of which are hereby incorporated by reference. The first radiating element 104 and the second radiating element 106 are closely spaced shallow null 1062 does not form.

Furthermore, the second antenna element 104 acts as a "capacitive hat" to a monopole antenna formed by inner conductor 111. Slot type radiation also exists between the second antenna element 106 and the first antenna element 104 and slot mode radiation may predominate over monopole radiation when the second antenna element and the first antenna element are closely spaced, as with close spacing the region between is second antenna element and the first antenna element is too close together for a wave to fit inside.

The first antenna element 104 can be said to comprise a ground plane to the second antenna element 106, so the antenna element 104 performs compound duties. The first antenna element 104 develops a radiation resistance under 50 ohms so conductive pins 124*a*, 124*b*, 124*c* are present to convert the radiation resistance to a driving resistance of 50 ohms or other desired value. The current flow in the conductive pins 124*a*, 124*b*, 124*c* is in a reverse direction to the flow of current on the inner conductor 111 such that the near fields surrounding the structures are opposing. This generates a work mechanism so to speak the cause the second antenna 106 driving resistance rise.

The diameter of the second antenna element 106 trades with height above the first antenna element 104. When the second antenna element 106 is very close to first antenna element 104, the second antenna element may have a diameter approaching λ/4. When the second antenna element 106 is more elevated above the first antenna element 104, the second antenna element 106 provides a lower radiation resistance. The conductive pins 124*a*, 124*b*, 124*c* are always available to convert the range of radiation resistances to 50 ohms. Radiation from the second antenna element 106 is mostly in the antenna plane and a modified sine function in shape.

Figure 10A:
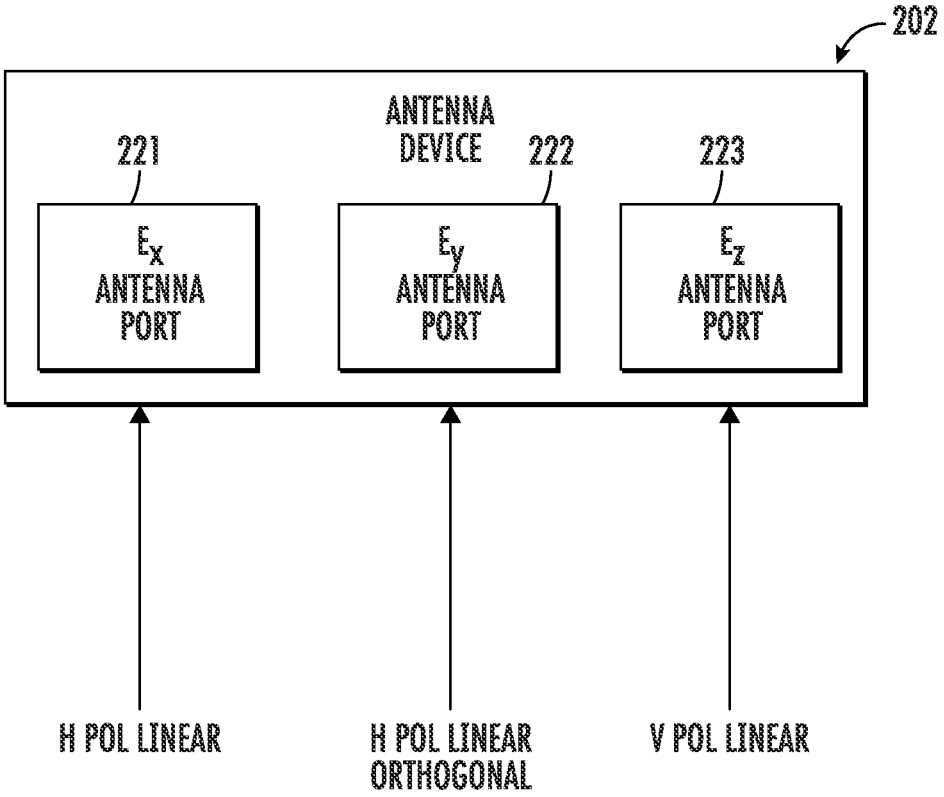
FIG. 10A is a schematic diagram of the antenna device from a second embodiment of satellite communications device of FIG. 1.

Referring now additionally to FIG. 10A, another embodiment of the antenna device 202 is now described. In this embodiment of the antenna device 202, those elements already discussed above with respect to FIGS. 1-9B are incremented by 100 and most require no further discussion herein. This embodiment differs from the previous embodiment in that this antenna device 202 illustratively provides three axis linear polarization. The connection ports 221, 222, 223 are driven respectively with a horizontal linear polarization, an orthogonal horizontal linear polarization, and a vertical linear polarization. In other words, the antenna device 202 can synthesize a vertical polarization.

Figure 10B:
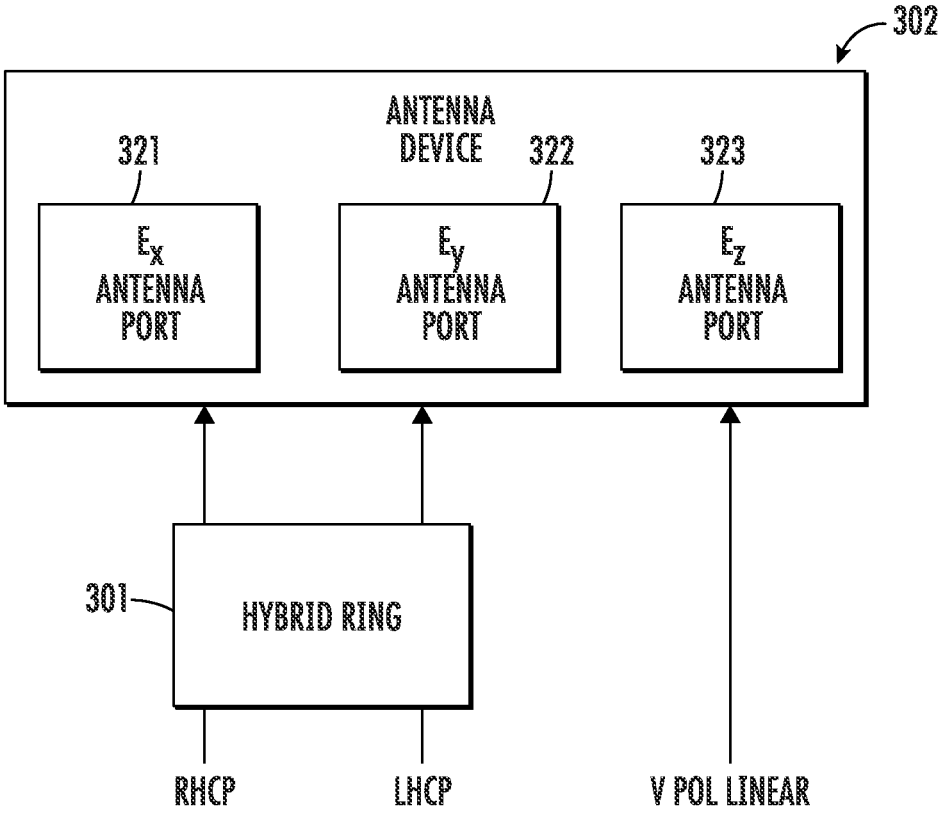
FIG. 10B is a schematic diagram of the antenna device from a third embodiment of satellite communications device of FIG. 1.

Referring now additionally to FIG. 10B, another embodiment of the antenna device 302 is now described. In this embodiment of the antenna device 302, those elements already discussed above with respect to FIGS. 1-9B are incremented by 200 and most require no further discussion herein. This embodiment differs from the previous embodiment in that this antenna device 302 illustratively provides dual circular polarization with a vertical line. The coupler 301 illustratively includes a hybrid ring coupler coupled upstream of the connection ports 321, 322, which are driven respectively with a Right Hand Circularly Polarized (RHCP) signal and a Left Hand Circularly Polarized (LHCP) signal. The connection port 323 is fed with a vertical linear polarized signal. In other words, the antenna device 302 can synthesize a circular polarization.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

The invention claimed is:

1. An antenna device comprising:

a ground plane;

at least one corrugation surrounding said ground plane;

a first planar antenna element spaced above said ground plane and having an opening therethrough;

a second planar antenna element spaced above said first planar antenna element on a side of said first planar antenna element opposite said ground plane, said second planar antenna element having a size smaller than said first planar antenna element; and a coaxial feed comprising an outer conductor and an inner conductor surrounded by said outer conductor and extending outwardly from an end of the outer conductor, said outer conductor coupled to said ground plane and said first planar antenna element, said inner conductor extending through the opening in said first planar antenna element and coupled to said second planar antenna element.

2. The antenna device of claim 1 wherein said first and second planar antenna elements define a vertical axis; and wherein said coaxial feed is aligned along the vertical axis.

3. The antenna device of claim 1 comprising at least one additional coaxial feed spaced from said coaxial feed and having an inner conductor coupled to said first planar antenna element.

4. The antenna device of claim 3 wherein said at least one additional coaxial feed comprises first and second additional coaxial feeds spaced apart for different antenna polarizations.

5. The antenna device of claim 1 comprising a plurality of conductive pins coupled between said first and second planar antenna elements.

6. The antenna device of claim 1 comprising dielectric material between said ground plane and said first planar antenna element, and between said first planar antenna element and said second planar antenna element.

7. The antenna device of claim 6 wherein said dielectric material comprises at least one of air and dielectric foam.

8. The antenna device of claim 1 wherein said first planar antenna element has a circular shape with a diameter in a range of 0.45-0.55 wavelengths of an operational frequency; and wherein said second planar antenna element has a circular shape with a diameter in a range of 0.2-0.3 wavelengths of the operational frequency.

9. The antenna device of claim 8 wherein said ground plane has a circular shape with a diameter greater than 0.45 wavelengths of the operational frequency.

10. A satellite communications device comprising:

a wireless transceiver; and an antenna device coupled to said wireless transceiver, said antenna device comprising a ground plane, at least one corrugation surrounding said ground plane, a first planar antenna element spaced above said ground plane and having an opening therethrough, a second planar antenna element spaced above said first planar antenna element on a side of said first planar antenna element opposite said ground plane, said second planar antenna element having a size smaller than said first planar antenna element, and a coaxial feed comprising an outer conductor and an inner conductor surrounded by said outer conductor and extending outwardly from an end of the outer conductor, said outer conductor coupled to said ground plane and said first planar antenna element, said inner conductor extending through the opening in said first planar antenna element and coupled to said second planar antenna element.

11. The satellite communications device of claim 10 wherein said first and second planar antenna elements define a vertical axis; and wherein said coaxial feed is aligned along the vertical axis.

12. The satellite communications device of claim 10 comprising at least one additional coaxial feed spaced from said coaxial feed and having an inner conductor coupled to said first planar antenna element.

13. The satellite communications device of claim 12 wherein said at least one additional coaxial feed comprises first and second additional coaxial feeds spaced apart for different antenna polarizations.

14. The satellite communications device of claim 10 comprising a plurality of conductive pins coupled between said first and second planar antenna elements.

15. The satellite communications device of claim 10 comprising dielectric material between said ground plane and said first planar antenna element, and between said first planar antenna element and said second planar antenna element.

16. The satellite communications device of claim 15 wherein said dielectric material comprises at least one of air and dielectric foam.

17. The satellite communications device of claim 10 wherein said first planar antenna element has a circular shape with a diameter in a range of 0.45-0.55 wavelengths of an operational frequency; wherein said second planar antenna element has a circular shape with a diameter in a range of 0.2-0.3 wavelengths of the operational frequency; and wherein said ground plane has a circular shape with a diameter greater than 0.45 wavelengths of the operational frequency.

18. A method for making an antenna device comprising:

positioning a first planar antenna element spaced above a ground plane and at least one corrugation surrounding the ground plane, the ground plane having an opening therethrough;

positioning a second planar antenna element spaced above the first planar antenna element on a side of the first planar antenna element opposite the ground plane, the second planar antenna element having a size smaller than the first planar antenna element; and positioning a coaxial feed comprising an outer conductor and an inner conductor surrounded by the outer conductor and extending outwardly from an end of the outer conductor so that the outer conductor is coupled to the ground plane and the first planar antenna element, and the inner conductor extends through the opening in the first planar antenna element and being coupled to the second planar antenna element.

19. The method of claim 18 wherein the first and second planar antenna elements define a vertical axis; and wherein the coaxial feed is aligned along the vertical axis.

20. The method of claim 18 comprising at least one additional coaxial feed spaced from the coaxial feed and having an inner conductor coupled to the first planar antenna element.

* * * * *